United States Patent [19]

Lange

[11] Patent Number: 4,512,117

[45] Date of Patent: Apr. 23, 1985

[54] MODULAR PROSCENIUM THEATRE

[75] Inventor: Fredric A. Lange, Osseo, Minn.

[73] Assignee: Interlock Structures International, Inc., Minneapolis, Minn.

[21] Appl. No.: 405,990

[22] Filed: Aug. 6, 1982

[51] Int. Cl.[3] ..... E04H 3/10

[52] U.S. Cl. ..... 52/6; 52/126.1; 52/646; 52/721; 403/331

[58] Field of Search ..... 52/6, 645, 646, 721, 52/125.1, 726, 126.5, 126.1; 254/47, 48, 4 R, 4 B, 4 C; 272/21, 9, 11, 25; 403/232.1, 245, 263, 240, 253, 331

[56] References Cited

U.S. PATENT DOCUMENTS

| | | | |
|---|---|---|---|
| 2,560,878 | 7/1951 | Kyle et al. . | |
| 2,705,386 | 4/1955 | Bertram . | |
| 2,715,013 | 8/1955 | Slick | 52/125.1 X |
| 2,846,221 | 8/1958 | Skinner | 272/21 |
| 3,158,354 | 11/1964 | Ward | 254/47 |
| 3,181,203 | 5/1965 | Wenger . | |
| 3,247,628 | 4/1966 | Miller . | |
| 3,358,848 | 12/1967 | Johnsson | 52/721 P |
| 3,414,087 | 12/1968 | Schmiesing | 254/4 R X |
| 3,417,518 | 12/1968 | Jaffe . | |
| 3,469,354 | 9/1969 | Meetze, Jr. | 52/6 X |
| 3,534,880 | 10/1970 | Washburn, Jr. et al. | 254/4 R X |
| 3,948,482 | 4/1976 | Brophy | 254/47 X |
| 3,961,426 | 6/1976 | Wallace . | |
| 4,019,298 | 4/1977 | Johnson | 403/331 X |
| 4,190,233 | 2/1980 | Godfrey | 254/4 B |
| 4,227,464 | 10/1980 | Wallace | 52/645 X |

OTHER PUBLICATIONS

"The Pack-Way Proscenium", *Theatre Crafts,* Mar.-/Apr. 1969.

"Instant Theatre", *Theatre Crafts,* Oct. 1969.

"Porto Theatre", *Theatre Crafts,* May/Jun. 1969.

*Primary Examiner*—Carl D. Friedman

*Attorney, Agent, or Firm*—Merchant, Gould, Smith, Edell, Welter & Schmidt

[57] ABSTRACT

A modular proscenium theatre (20) is disclosed. Theatre (20) includes transverse truss beams (24) connected together by flat truss sections (26) supported on columns (22). Cantilevered members (28) support lights (30). A cross-over curtain (36) is hung from a traveler track (150). Side masking curtains (38) are adjustable longitudinally and rotatably. Other masking curtains and a cyclorama screen (40) may be provided. The framework, the lights and curtains are assembled near floor level and elevated with hoist motors (78) using pulleys (50) and cables (94). The entire theatre (20) may be assembled and disassembled with two people.

26 Claims, 12 Drawing Figures

MODULAR PROSCENIUM THEATRE

TECHNICAL FIELD

This invention relates to the field of theatre arts and, more particularly, discloses a modular proscenium theatre which may be rapidly assembled or disassembled by two people.

BACKGROUND OF THE INVENTION

During the middle ages, troubadors, jugglers and other entertainers roamed the main routes of Europe, carrying songs, dances, tricks, and tales to the great feudal castles and town market squares. Their stages were often impromptu and could be found in nature, or borrowed from an existing porch or building. Sometime thereafter, the one man showman put his props and trapings into a cart before going on the road. In early America, there was a time when steamboats were rigged out as show boats. There was also a time when railroad box cars and flat cars competed with colorful circus wagons as stages.

These early beginnings are perhaps manifested in contemporary society in what is called "street theatre". Oftentimes in the summer small theatre groups will take to the street with a portable stage including a truck trailer or something similar. U.S. Pat. Nos. 2,560,878 and 3,181,203 are exemplarly of theatres on wheels for street use.

Theatre in the hinterlands, however, is not limited to small groups taking to the streets. There is at least one project documented wherein the United States State Department was faced with the problem of sending examples of American theatre to foreign lands. In response to this problem, a so-called portable theatre was designed to have a stage, seating area, and various other support elements including an inflated dome to protect those inside from the weather. This theatre was transportable in a pair of jet cargo planes.

On a more mundane level, small children's theatres or puppet theatres are also known. U.S. Pat. Nos. 2,705,386; 3,247,628 and 3,961,426 are exemplars.

Most relevant, however, to the present invention would be a type of portable theatre which transforms an interior space into theatre space which may be viewed by an audience. Recognizing what would be a most relevant field of art, however, does not imply substantial development of the field. In this case, the contrary is true. There are known, of course, various types of non-portable stages and proscenium theatres around which a building or room is constructed as a permanent facility. Also, a foldable theatre is known which is stored within or adjacent to a wall, and for use, folds or telescopes outwardly from the wall to form a theatre space. Further, table-like portable stages are known and are sometimes used in combination with a grid-like structure suspended from above. Such known combinations, however, may include movable tables, but any theatre space, even if created in a first location, is not modular and readily movable among a variety of locations. The present invention solves this problem. The present invention is not a stage, although it may be used with a stage. The present invention includes apparatus which creates a theatre space. The apparatus is modular. The apparatus is readily versatile and portable.

SUMMARY OF THE INVENTION

The present invention is directed to a portable proscenium theatre having a front cross-over curtain and a plurality of lights for illuminating acting space behind the curtain. An overhead frame mechanism comprised of connectable and disconnectable modular sections supports the curtain and the lights. The portable theatre includes a plurality of vertical columns for supporting the frame mechanism and mechanism for elevating the frame mechanism from floor level to retain it at a vertical height. The elevating mechanism is attached to both the frame mechanism and the columns. In this way, the frame mechanism is easily assembled or disassembled manually at floor level and thereafter elevated to an operational theatre height.

More particularly, the overhead mechanism is comprised of modular frame sections connected together to form a framework having transverse beams connected together by longitudinal members. The transverse beams are comprised of modular, triangular truss sections having a particularly appropriate V-shaped bracket connecting mechanism. The longitudinal portions of the framework are preferably a flat-type truss section. The flat truss members are connected at the ends to the triangular truss beams thereby forming a rectangular framework.

The framework may be advantageously supported in at least three different ways. Firstly, the framework may be removeably attached at the ends of the transverse beams to building side walls. Secondly, the framework may be suspended from the ceiling of a building. Thirdly, the framework may be supported by a plurality of vertical columns or cylinders.

The latter two embodiments are particularly advantageous when used with novel arrangements of motors and cable and pulley combinations. In the case of the second embodiment, pulleys are suspended from a ceiling structural member. Motors having shafts with axes parallel to the transverse beams are attached to brackets near the ends of the transverse beams. A cable is connected to a particular motor shaft and passed about a corresponding pulley hung from the ceiling before extending downwardly for attachment to the transverse beam in the vicinity of the motor shaft. In this way, when all the motors are wired to a common control mechanism, all may be energized simultaneously to utilize the cable and pulley combinations to lift or to lower the framework.

In the third embodiment, a spaced apart pair of two spaced apart rollers are attached to the opposite side of the motor bracket as that to which the motor is attached. Each roller is shaped to conform to the cylindrical shape of the supporting column. Each pair of rollers is spaced apart to allow the column to pass therebetween. Instead of being suspended from the ceiling as in the second embodiment, pulleys are rotatably attached to the tops of the supporting columns. Cables are connected from the motor shafts to pass about the pulleys for attachment thereafter to the transverse beams in a fashion similar to the second embodiment. As the motors are operated, the framework is guided by the several pairs of rollers along the columns to be lifted or lowered by the cables.

Lights may be supported from bars hung from the transverse beams or from cantilevered members attached to the transverse beams. Since the transverse beams have spaced apart rods forming the corners of the triangular cross-sectional shape with two of the rods substantially level and above the third, the cantilevered member is advantageously supported by a pair of attached channel members. That is at one end of a cantilevered member, a channel member opens toward the other end of the cantilevered member. Near the middle of the cantilevered member, a channel member opens downwardly. Thus, when a light is suspended from the cantilevered member, the rearward channel member prevents the cantilevered member from pivoting about the middle channel member thereby holding the assembly in place.

Yet another novel structure supports side masking curtains. The longitudinal truss sections are constructed to include an upwardly opening channel member as the top member. A trolley type device having a body and four wheels pivotally supports a rod which in turn supports the side curtains, thereby allowing each side curtain to move longitudinally and to rotate about a substantially vertical axis.

The modular concept of the present invention is maintained to include a traveler track for a front cross-over curtain. The traveler track is foldable with hinges including lock provisions.

Thus, the present invention addresses the need for a modular, portable apparatus which can conveniently provide theatre or show space for entertainment, studio, display and theatre requirements. By simply adding or taking away truss sections, the theatre space is readily expandable or contractable. Assembly and disassembly takes no tools. The complete mechanism may be taken apart and easily moved by two people. In like manner, the same number of people may easily put the various modular pieces together including curtains and lights and operate the control mechanism for the motors and lights to create quickly a professional theatre environment. When used in combination with a portable stage, a theatre similar to those of fixed installations may well result. At the same time, the apparatus provides great versatility in that two people may move the apparatus among various sites. For example, a single school district may own one theatre, yet readily move it among a variety of school buildings. Truly, the present invention solves a contemporary need.

In addition to using the various pieces of the apparatus to create a theatre space as indicated, the modular components of the present invention may be used advantageously to create other useful theatre equipment. For example, a column may be supported by a base to rise vertically from the floor of a building. The top of the column has a pulley rotatably attached. By using one or more of the triangular truss sections, one being outfitted with a motor and the two pair of two rollers guide mechanism, a support mechanism is available wherein lights may be hung from the truss sections in fashions discussed hereinbefore. As with the overhead framework of the portable theatre, the lights may be attached to the truss sections while the truss sections are located near ground level. Thereafter, the motor may be operated to elevate the truss sections and the lights to an appropriate higher level. Such equipment, known as a light tree, is then available to augment other theatre lighting.

These various advantages and other objects obtained by the use of the present invention and its modular components are further explained and may be better understood by reference to the drawings which form a further part of this disclosure and to the accompanying descriptive matter in which there is described in more detail a preferred embodiment of the invention.

DETAILED DESCRIPTION OF THE INVENTION

Figure 1:
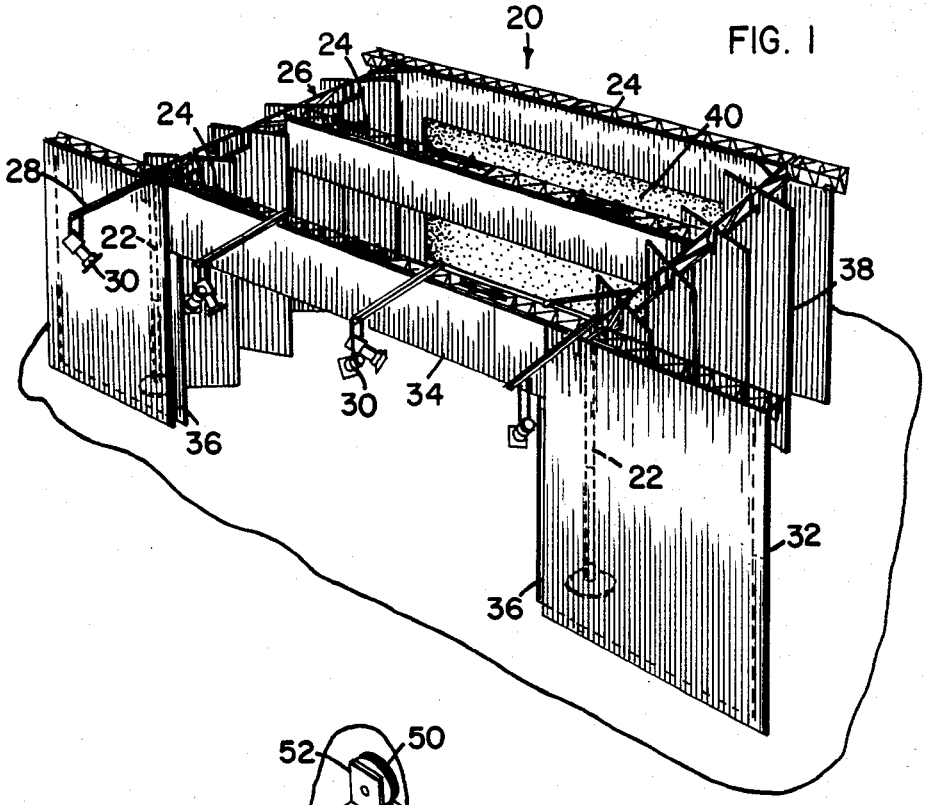
FIG. 1 is a perspective view of a modular theatre in accordance with the present invention.

Referring now to the drawings wherein like reference numerals designate identical or corresponding parts throughout the several views and, more particularly to FIG. 1, a modular theatre in accordance with the present invention is designated generally as 20. In general, theatre 20 is supported by columns 22, a couple of which are shown in phantom lines in FIG. 1. Transverse truss beams 24 connected together by flat truss sections 26 are supported on columns 22. Cantilevered members 28 support lights 30 from at least the front beam 24. Front beam 24 also supports masking curtains 32 extending outwardly from the stage opening, extending commonly to a side wall of the room. Additional masking curtains 34 are draped downwardly from the upper front rod of each transverse beam 24 for the purpose of masking or hiding the transverse beams and apparatus connected to or held by them. A front cross-over curtain 36 is hung as appropriate from the front transverse beam 24. Side masking curtains 38 control audience sight lines and provide easy on and off access to the stage area. A cyclorama screen 40 may be provided at the rear of the theatre space.

Figure 2:
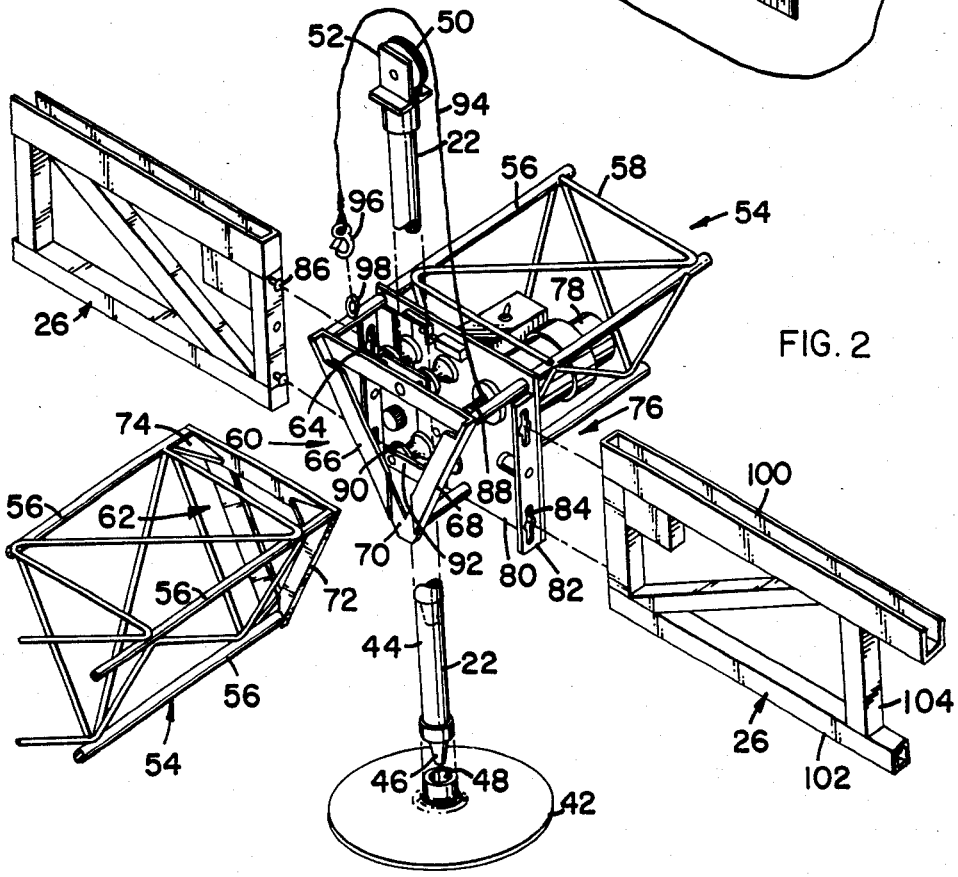
FIG. 2 is a partially exploded, perspective view of a support column with triangular and flat truss sections.

More particularly, a support column 22 is shown in FIG. 2. Support column 22 is connected to and is supported vertically by a base 42. Support column 22 is preferably comprised of a plurality of modular cylinders 44 having male projections 46 at one end to fit within female cavities 48, such as shown in base 42. The uppermost cylinder 44 at its top has a pulley 50 rotatably attached to a bracket 52. The purpose of pulley 50 will become apparent hereinafter. It is noted too that although a cylinder is preferable, support column 22 could have other cross-sectional shapes.

Figure 7:
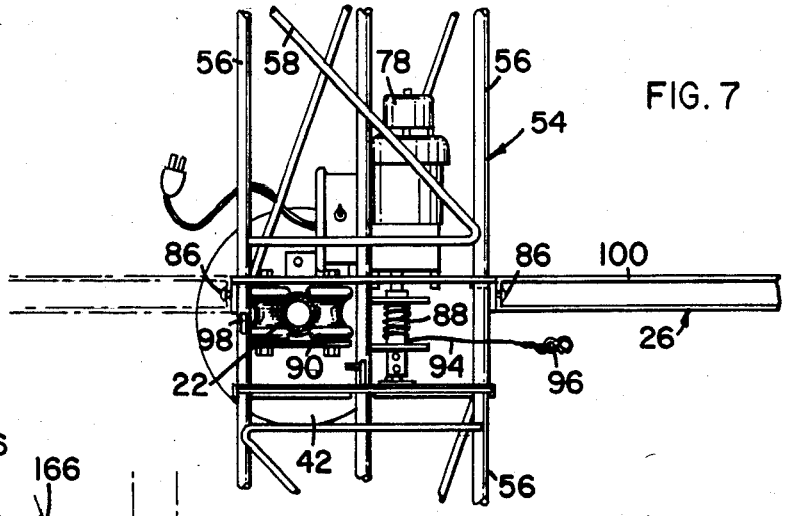
FIG. 7 is a top view of a pair of connected triangular truss sections with connected flat truss sections as fitted on a support column shown in cross-section.

Support columns 22 provide support for the transverse and longitudinal beams 24 and 26 of FIG. 1. Particular modular sections as they interconnect among themselves and with support column 22 are shown in FIGS. 2 and 7. Triangular truss sections 54 shown in the drawings are comprised of three aligned rods 56 at the corners with truss structural elements 58 extending between rods 56 and attached thereto by weld or other equivalent fastening mechanism. One end of a truss section 54 forms a female portion 60 of a V-lock for mating with the male counter part 62 at the opposite end of an adjacent truss section 54. Female portion 60 is comprised of a triangular plate 64 having spaced apart walls 66 along the two sides of an upright V. A back plate 68 connects walls 66 and triangular plate 64. The apex or bottom angle of female portion 60 does not include portions of walls 66 or wall back 68 as shown at 70. In this fashion, male V-lock 62 is comprised simply of triangular plate 72 to fit between triangular plate 64 and walls 66 so as to allow the bottom rod 56 to pass through the bottom portion of the V-lock thereby allowing the edges of plate 72 to contact back walls 68. In the drawing, the central portions of plates 64 and 72 are cut away to allow electrical wiring to be routed therethrough. Each plate 64 and 72 may be further strengthened with gussets 74. The V-lock configuration allows one triangular truss section 54 to support another.

A typical bracket 76 to which a motor 78 and one or two flat truss sections 26 are attached is fastened to a triangular truss section 54 as shown in FIGS. 2 and 7. Bracket 76 is preferably a flat, square plate 80 welded or otherwise fastened at appropriate points to the three rods 56. A pair of plates 82 extend perpendicularly from plate 80 at its vertical side edges. Each plate 82 has a pair of vertical slots 84 therein with an enlarged portion for the receipt of the heads of bolts or screws 86 attached to the ends of flat truss sections 26. The heads of bolts 86 are spaced sufficiently outwardly from the ends of flat truss sections 26 to allow them to protrude through the enlarged portions of slots 84 so that as flat truss sections 26 are allowed to move downwardly the shanks of bolts 86 fit snugly in slots 84 and flat truss sections 26 bind against plates 82.

A particular motor 78 has a shaft 88 which extends through plate 80. Motor 78 is otherwise attached to bracket 76 in a common fashion. Motor 78 is offset to one side from an imaginary line which passes through apex 70 and bisects the distance between upper rods 56. On the other side of that line, a vertically spaced apart pair of two horizontally spaced apart rollers 90 are preferably rotatably attached to bracket 76. Rollers 90 are shaped to receive support column 22 between them so that the pair of two rollers may guide a truss section 54 as it is elevated or lowered. A strap 92 is attached between a particular pair of rollers 90 to prevent them from separating. The lift mechanism then is comprised of a cable 94 attached at one end to shaft 88 of motor 78, wrapped partially about pulley 50 and attached at the other end with hook 96 to an eye 98 welded or otherwised fastened to one of upper rods 56 of triangular truss section 54. When motor 78 is operated, the cable 94 is either shortened or lengthened as it wrapes or unwraps about shaft 88 thereby lifting or lowering the particular truss section 54.

Figure 6:
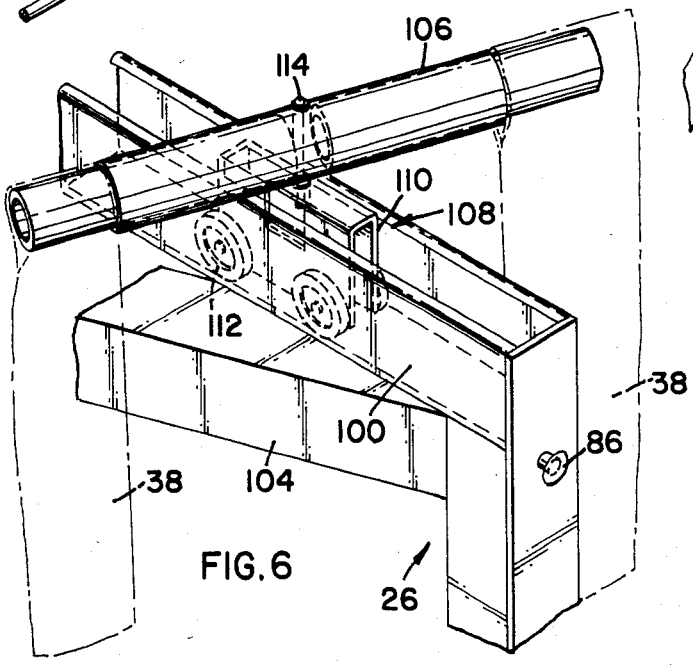
FIG. 6 is a perspective view of the transport assembly for side masking curtains.

Flat truss sections 26 have upper and lower members 100 and 102 with various truss members 104 providing structure therebetween. Upper member 100 is a channel opening upwardly. Member 100 serves as a conduit for various electrical cabling, particularly interconnect power cables for motors 78 and control cables for same. Also, as shown in FIG. 6, side masking curtains 38 are supported by a tube 106 rotatably attached to a trolley 108 received within the channel of upper member 100. Trolley 108 includes a body 110 having a plurality of wheels 112 rotatably attached near its bottom. A screw and nut combination 114 or other similar assembly provides a pivotal attachment with a vertical axis between tube 106 and trolley 108. In this fashion, side masking curtains 38 may be positioned longitudinally along flat truss section 26, as well as rotationally about axis 112 thereby achieving advantageous adjustability.

Figure 4:
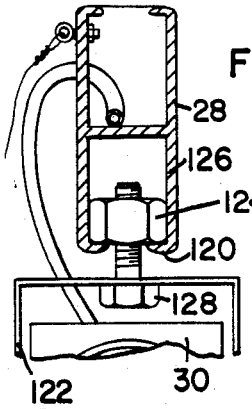
FIG. 4 is a cross-sectional view taken along line 4—4 of FIG. 3.
Figure 3:
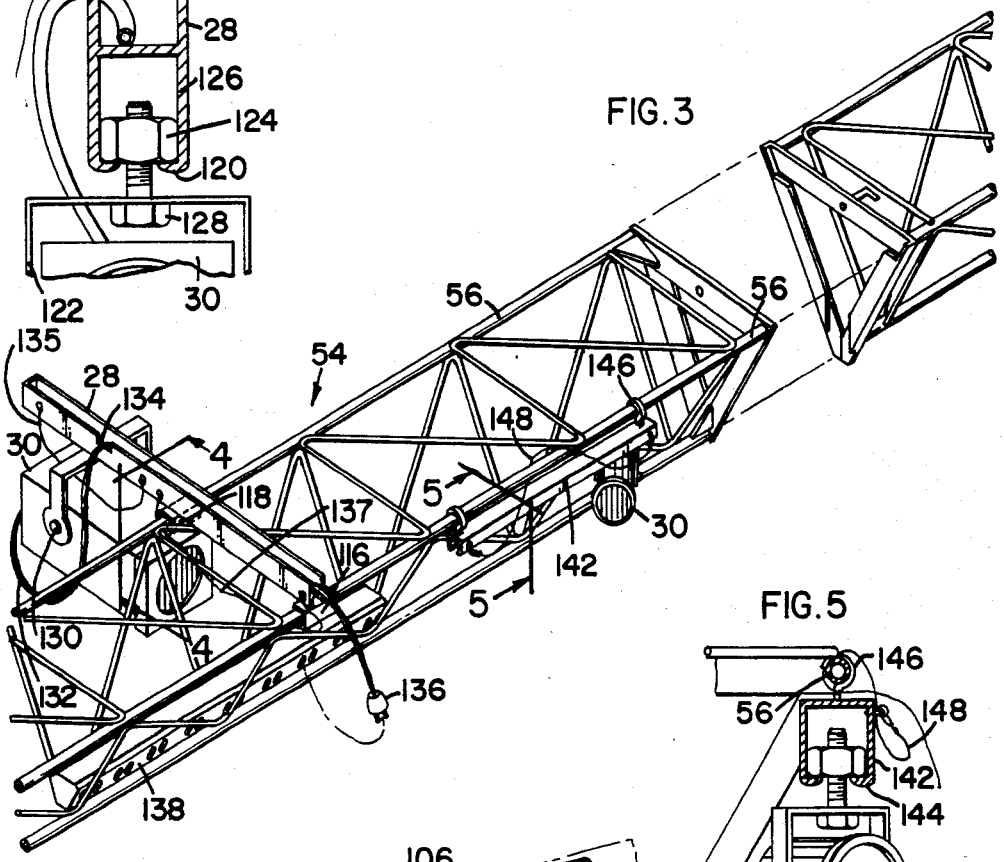
FIG. 3 is a perspective view of a pair of triangular truss sections, also showing light supporting elements.
Figure 5:
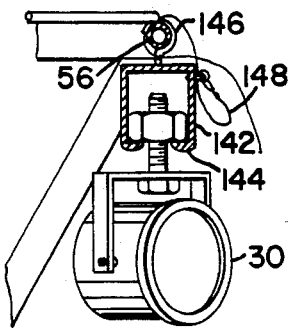
FIG. 5 is a cross-sectional view taken along line 5—5 of FIG. 3.

In FIGS. 3–5, a triangular truss section 54 is shown with two different mechanisms for suspending lights therefrom. A cantilevered member 28 has a pair of channel brackets 116 and 118 which bind member 28 to truss section 54 when a load such as light 30 is supported from the cantilevered portion of member 28. Both of channels 116 and 118 are attached to the bottom of member 28. Channel 118 is located between the ends of member 28 and opens downwardly. Channel 116 is near one end of member 28 and opens toward channel 118 and the cantilevered portion of member 28. Channels 116 and 118 are separated the same distance as the upper two rods 56 of truss section 54. In this fashion, cantilevered member 28 is moved to allow channel 116 to receive one of rods 56 and then pivoted downwardly to allow channel 118 to receive the second rod 56. Thus, when a load is attached to the cantilevered end of member 28, member 28 trys to pivot about channel 118 but is restrainted by channel 116.

As shown in FIG. 4, cantilevered member 28 preferably has an H-shaped cross-section with inward turning lips 120 on at least the bottom legs. Light 30 is supported by a bracket 122 attached to a nut and bolt combination 124 and 128 supported from lips 120. Light 30 may be moved longitudinally on cantilevered member 28 by moving nut 124. Also, bracket 122 includes a pivotal attachment at 128 and 130 (see FIGS. 3 and 4) as commonly known to further adjust light 30. The wiring 132 for light 30 is conveniently routed through a notch 134 in the upper wall of the H section of cantilevered member 28 and thereafter along the upper portion of member 28 to the end near channel 116. Therefrom, plug 136 may be attached to a plug strip 138.

A safety cable 135 for light 30 is attached at its ends to the cantilevered portion of member 28 while passing through bracket 122 therebetween. Similarly, safety cable 137 is wrapped about portions of truss section 54 while being fastened at the ends thereof to member 28.

A second mechanism for suspending a light 30 from truss section 54 utilizes channel 142 opening downwardly with inturned lips 144 for holding light 30 in a fashion similar to that described hereinbefore. Channel 142 is hung from a rod 56 by a pair of hooks 146 or other similar mechanism near opposite ends thereof. A safety cable 148 is attached at its ends to channel 142 and therebetween wrapped about rod 56.

Figure 8:
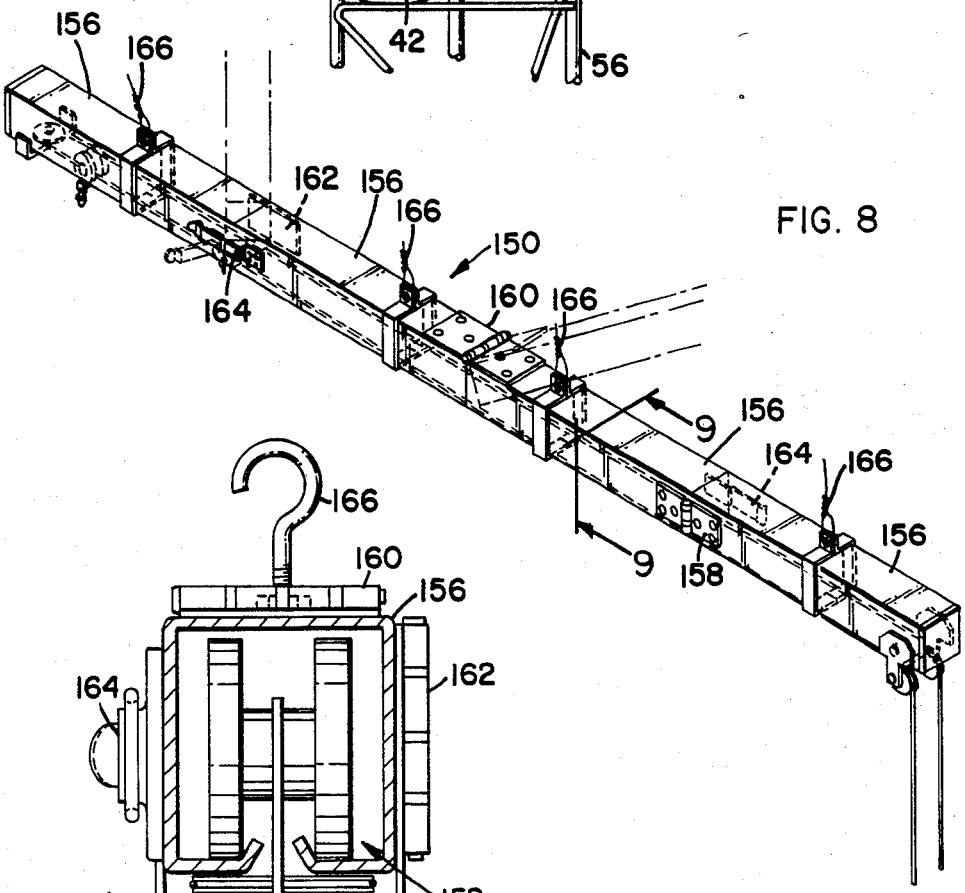
FIG. 8 is a perspective view of a traveler track.
Figure 9:
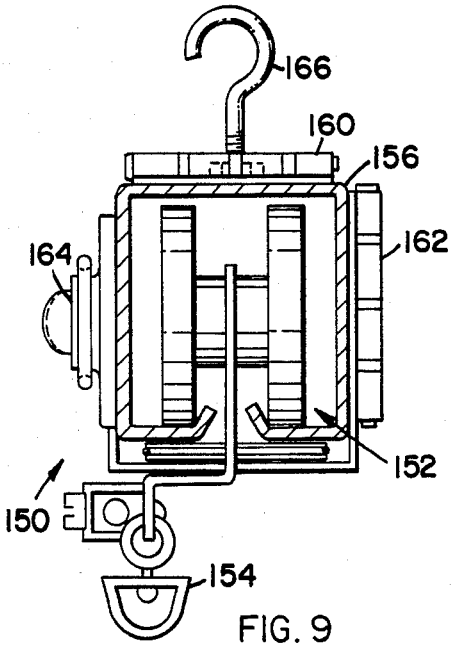
FIG. 9 is a cross-sectional view as taken along line 9—9 of FIG. 8.

In FIGS. 8 and 9, a traveler track 150 for carrying cross over curtain 36 is shown. Traveler track 150 is a box section extrusion having a slot centered on its bottom wall extending from end to end. An axle and wheel arrangement 152 of a type commonly known and similar to that described in FIG. 5 is used for each curtain attachment device 154. Traveler track 150 is foldable in keeping with the portable concept of the present invention. The traveler track 150, shown in the drawings, is comprised of four sections 156 connected together by hinges 158, 160 and 162. Each of the hinges connects together a pair of members 156 along different walls of the box section exclusive of the wall having the slot in it. In this fashion, multiple sections may be folded without interferring thereby allowing a long traveler track to be easily transported without taking apart in individual members 156. Upon being unfolded, commonly known overcenter latches 164 prevent hinges 158 and 162 from refolding. Traveler track 150 is hung on one of rods 56 of the front truss beam 24. Hooks, cables or a similar hanging mechanism 166 are spaced along the top surface of traveler track 150.

Figure 12:
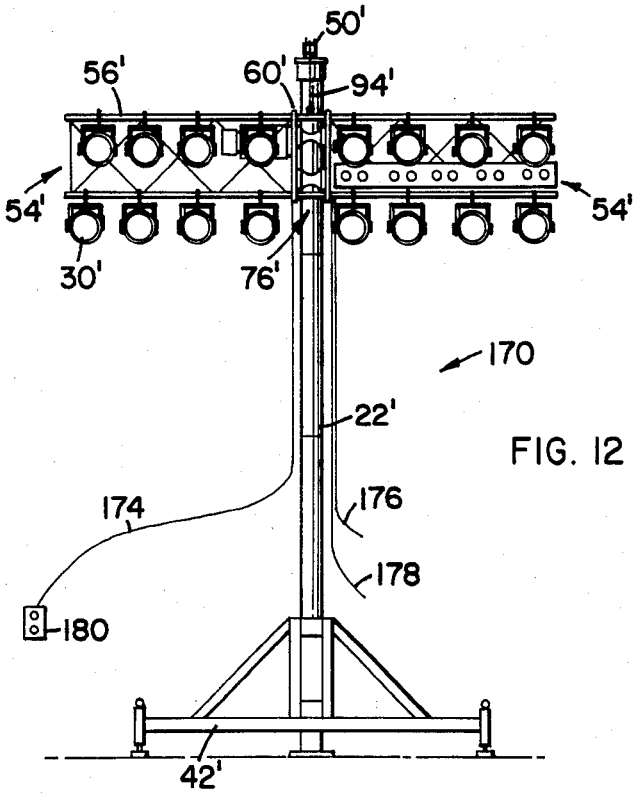
FIG. 12 is a front view of a support column with attached triangular truss sections for use as a light tree.

A number of other embodiments are apparent for portions of the preferred structure of the present invention. For example, a light tree 170 is shown in FIG. 12. Light tree 170 includes a support column 22' held by a base 42'. A pair of triangular truss sections 54' are connected together at V-lock bracket 60'. One of truss sections 54' includes a bracket 76' with motor and spool combinations, attached as described hereinbefore with respect to FIG. 2, for raising and lowering truss sections utilizing a pulley 50' and a cable 94'. A plurality of lights 30' is attached to one or two of rods 56' of truss sections 54' or by using member 28 or 142 as described hereinbefore. Cables 174, 176 and 178 lead to a control device 180 for the hoist motor, a dimmer control device (not shown) and a power source (not shown), respectfully. By operating the hoist motors, the truss sections 54' advantageously raise and lower in the manner hereinbefore described along support column 22'. Thus, additional lighting is readily obtained to augment that already available on theatre 20 by using these additional modular components to construct light tree 170.

Figure 10:
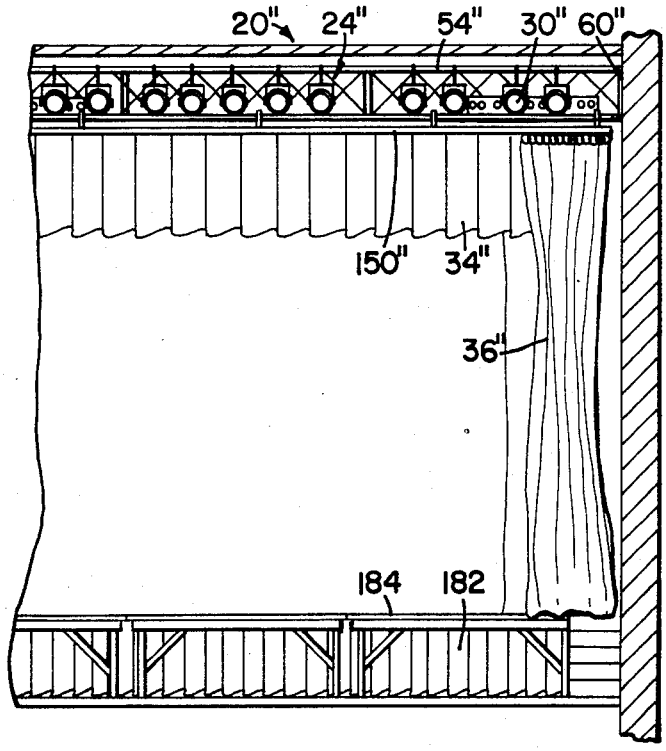
FIG. 10 is an alternate embodiment of a modular theatre in accordance with the present invention showing triangular truss sections mounted to building walls.

A second embodiment of a modular theatre 20'' is shown in FIG. 10. In an appropriate building, one or both walls of a room may be used as the side supports for the truss framework of the present invention. A female portion 60'' of a V-lock bracket is attached at the appropriate location on a side wall. If opposite walls are used, female V-lock brackets 60'' are attached opposite one another on both side walls. Alternatively, a support column 22 could be used on one side of the beam 24''. It is noted that use of a wall as a vertical structural support eliminates the need for flat truss sections, like 26, and side masking curtains, like 38. In other respects, the modular theatre of the second embodiment is similar to that of the first embodiment. That is, a plurality of triangular truss sections 54'' are connected together to form transverse beams 24''. A plurality of lights 30'' are attached thereto. A traveler track 150'' holding a cross over curtain 36'' is hung from a transverse beam 24''. Masking curtains 34'' and 182 for covering the front of a portable stage 184 are hung as appropriate.

Figure 11:
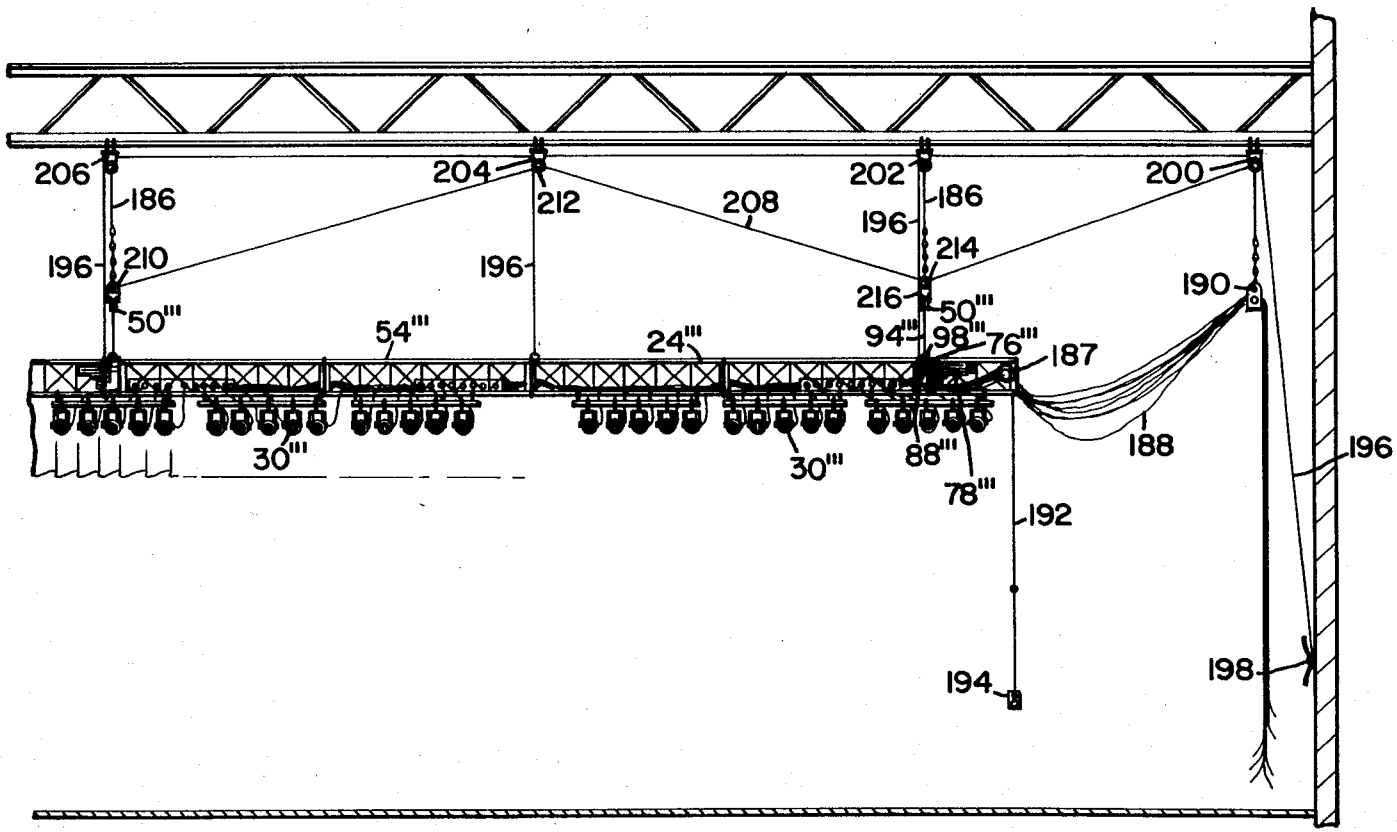
FIG. 11 is an alternate embodiment of a modular theatre in accordance with the present invention showing triangular truss sections formed into beams and supported from a building ceiling.

In a third embodiment as shown in FIG. 11, a truss beam 24''' holding a plurality of lights 30''' is shown as being supported from the structural portion of a ceiling of a building. A pair of pulleys 50''' are suspended rotatably from a pair of chains or cables 186. Motors 78''' are fastened to a bracket 76''' so as to align motor shafts 88''' with pulleys 50''' whereby a cable 94''', in a fashion as described hereinbefore, is attached to motor shafts 80''' so as to rise upwardly and partially about pulleys 50''' before extending back downwardly for attachment to eyes 98''' on transverse beam 24'''. Electrical cables 188 connected between hoist motors 78''' and a power source (not shown), lights 30''' and a power source (not shown) and lights 30''' and a control device (not shown) are routed within and supported by a plurality of truss sections 54''' which make up truss beam 24'''. At one end of beam 24''' cables 188 are kept taut by take up mechanism 187 before proceeding, as shown in the drawing, to a cable cradle 190 and dropping to the floor and being routed to a power source and control device as mentioned hereinbefore. A control cable 192 is connected between hoist motors 78''' and a control device 194. Control cable 192 likewise is routed within beam 24''' for a subsequent routing to floor level. Control device 194 is available thereafter to control motors 78''' for raising and lowering beam 24'''.

It is advantageous to use one or more safety cables 196 in conjunction with a ceiling suspended truss beam 24'''. Three safety cables are shown in the drawing as extending from an anchor 198 upwards to a change of direction pulley assembly 200 and thereafter to additional pulley assemblies 202, 204 and 206 for another change of direction before extending downwardly for attachment to beam 24''' at three separated locations. A sway stablizing cable 208 extends from attachment with bracket 210 interconnecting pulley 50''' with chain 186 diagonally upwardly to a pulley 212 at assembly 204, then diagonally downwardly to a pulley 214 at bracket 216 interconnecting pulley 50''' with cable 186 at the opposite end of transverse beam 24''', then diagonally upwardly for final attachment to pulley assembly 200.

In use, the various modular elements and the various curtains are disassembled and folded into convenient lengths and are sufficiently light and small so that a single person or at most two people can lift and move them about. Additionally, the present invention allows the same single person or two people to assemble these various elements to a degree that when needed electrical energy may be applied for the purpose of completing the theatre space.

To assemble, four or six or some other number of column bases 42 are appropriately placed in a spaced out substantially rectangular shape at a location where it is desired to create the theatre space. Two or more bases may be located along each proposed side of the theatre space. Additionally, bases 42 may be located outwardly from the front of the purposed theatre space to support masking curtains.

Next, the lowermost modular cylinder of columns 22 is inserted into each base 42. Then, the numerous modular triangular and flat truss sections 54 and 26, respectively, are assembled for elevation to form an overhead framework from which to support the various lights and curtains, associated wiring and other elements. Firstly, triangular truss sections 54 having brackets 76 with motors 78 attached thereto are installed. One such section 54 is installed on each support column 22. In each case, the truss section 54 is placed over support column 22 and allowed to rest on the floor, support column 22 being received between each set of spaced apart rollers 90. Additional triangular truss sections 54 are connected to these first installed sections 54 by mating the male and female portions of the V-lock connection. That is, plate 72 is slid downwardly between plate 70 and wall 66 intil it contacts wall 68 at each V-lock connection. With all triangular truss sections 54 in place, the longitudinally oriented, flat truss sections 26 are installed by inserting the heads of screws 86 through the enlarged portions of slots 84. As indicated previously, each truss section 26 then slides somewhat downwardly to allow the screws 86 to bind against plate 82 thereby supporting each truss section 26. This then completes what will become the overhead framework.

Next, the remaining modular cylinders of support column 22 are installed. A column with a pulley 52 is installed as the top cylinder of each support column 22. Cable 94 is then unwound from each shaft 88 of motor 78 to extend upwardly and partially about pulley 52 before proceeding back downwardly for connection between hook 96 and eye 98.

Plug strips 138 are inserted at appropriate locations in truss beams 24. Various wiring harnesses for interconnecting the plurality of motors 78 with a power source and with a control device and for interconnecting the many lights yet to be installed with a power source and a dimmer control are emplaced. The various electrical cables of the wiring harnesses are routed through the plates 70 and 72 of the V-locks and allowed to rest along the lower angle of the triangular truss beams 24. The cables are routed to an appropriate end of truss beams 24 so that they may extend away from and toward the appropriate connecting power source or control device after the framework is raised.

Although not necessary, it is at this point often convenient to connect the motor harness to a power source and a control device in order to raise the framework to approximately chest level for installation of lights and curtains. Considering the installation of lights 30 first, members 28 are installed at appropriate locations along appropriate transverse beams 24 by orienting the particular member 28 so that channel 116 may receive the rearward most rod 56. Member 28 is then pivoted downwardly to allow channel 118 to receive the forwardmost rod 56. One or more lights 30 are then installed on the cantilevered member 28. The electrical wire is routed through notch 130 and along the upper portion of the H-shaped member 28 so that plug 136 may connect with an appropriate plug strip 138. Safety cables 135 and 137 are attached to hold light 30 to member 28 and to hold cantilevered member 28 to a section 54 of beam 24.

Alternatively a light 30 may be installed in a similar fashion in a member 142 which is then hung with hooks 136 from a rod 56. A safety cable 148 prevents channel 142 and light 30 from being separated very far from the rod 56 to which channel 142 is hung.

Finally, the various curtains are hung. To install side masking curtains 38, trolley 108 having rotatably connected rods 106 are inserted at appropriate locations in upper channel member 100 of flat truss sections 26. Side masking curtains 38 are hung in a known fashion from rod 106.

To install front cross over curtain 36, traveler track 150 is unfolded at hinges 158, 160 and 162. Lock mechanisms 164 are locked to prevent refolding. Traveler track 150 is then hung with mechanism 166 from the lower rod 56 of the front truss beam 24. Cross over curtain 36 is attached to the curtain attachment devices 154 in a known fashion.

Various other masking curtains 32 and 34 are attached in known ways to mask the frame structure. Similarly, cyclorama curtain 40 is hung.

With all the lights and curtains attached and preliminarily positioned, motors 78 are simultaneously operated by the appropriate control device to raise the framework including attached lights and curtains. Each motor 78 rotates its shaft 88 to one cable 94 thereabout. As cables 94 shorten, the framework rises. With the framework at its elevated height, final adjustments may be made to all the various curtains and lights thereby finalizing a professional theatre space.

A modular theatre 20 in accordance with the present invention is disassembled simply by reversing the assembly steps. It is to be understood, of course, that many of the assembly and disassembly steps may be done in an order other than that described hereinbefore.

With respect to the various alternate embodiments, light tree 170 is assembled and disassembled very similar to the procedure just described. That is, a modular cylinder of column 22' is installed as appropriate in base 42'. A triangular truss section 54' having a bracket 76' with attached motor is fitted about the cylinderical column 22'. If desired, additional truss sections 54' are emplaced utilizing the V-locks. Various lights 30' are attached in the fashion described previously. The wiring harness and a plug strip is put in place. The wiring cables extending to a power source, a dimmer control device, and a control device 180 for the hoist motor are emplaced to drop downwardly along column 22'. The remaining cylinders of column 22' are installed so that a pulley 50' is at the very top. Cable 94' is extended as described previously. With the hoist motor empowered, control device 180 may be operated to raise truss sections 54' thereby allowing final adjustment of lights and location of tree 170. Assembly steps are reversed for disassembly.

To assemble various modular components as described with respect to the second embodiment of the present invention as shown in FIG. 10, firstly the female portion 60'' of a V-lock must be fastened to the structural portion of a wall. As indicated previously, walls may be used as the structural supports on both sides of the theatre space with respect to this embodiment. Alternatively, support columns 22 may be used as necessary. With the female portion 60'' of the V-lock installed, a plurality of triangular truss sections 54'' may be locked together utilizing V-locks as described hereinbefore. Thereafter, lights and curtains may be hung in a fashion already described.

With respect to the third embodiment of the present invention as shown in FIG. 11, a beam 24''' is adjustably hung from a ceiling structural member. To install, pulley assemblies 200, 202, 204 and 206 are attached to the ceiling structural member. Spaced apart cables 186 are hung from locations in the vicinity of pulley assemblies 202 and 206 as shown in FIG. 11. Pulleys 50''' are attached at the lower end of cables 186. A sway cable 208 is attached to assemblies 210, 204, 214 and 200. A cable cradle 190 is suspended from the vicinity of assembly 200. With anchor 198 installed in a side wall, safety cables 196 are strung over pulley 200 and individually about pulley assemblies 202, 204 and 206 to extend downwardly to floor level.

A triangular truss beam 24''' is assembled at floor level. Truss sections 54''' having motors 76''' are located at the ends of the beam so motor shafts 88''' align with pulleys 50'''. In the usual fashion, other triangular truss sections 54''' are connected together with the V-lock mechanism. Lights 30''' are then attached in a fashion described hereinbefore. Similarly, plug strips 138 and wiring harnesses for the hoist motors and the lights are installed. A take up mechanism 187 is advantageously used to prevent electrical cables from dropping excessively between beam 24''' and cradle 190. The cables are appropriately routed in a fashion described previously. Although curtains are not shown in FIG. 11, curtains may be installed. Safety cables 196 are attached to beam 24'''. Thereafter, control device 194 may be used to operate hoist motors 76''' to raise truss beams 24''' and the elements attached to it. Safety cables 196 are made taut and secured at anchor 198.

Disassembly proceeds in a similar, but reverse fashion.

It is apparent that the modular components of the present invention are used advantageously to create a theatre space in a fashion which minimizes manpower and assembly time. The various modular components are also advantageously used for additional embodiments as described hereinbefore. It is further clear therefore that the present disclosure is illustrative with respect to the numerous characteristics and advantages of the invention. Consequently, it is understood that any changes made, especially in matters of shape, size and arrangement, to the full extent extended by the general meaning of the terms which the appending claims are expressed, are within the principle of this invention.

What is claimed is:

1. A theatre comprising:

a movable curtain for separating acting space from nonacting space;

a light for illuminating said acting space;

overhead frame means for supporting said curtain and said light, said frame means including a plurality of modular sections and first means for disconnectably attaching adjacent said sections together, said attaching means including an element attached to one of each adjacent pair of sections and a cradle for receiving said element attached to a second of said adjacent pair, said cradle having spaced apart side walls and a back wall whereby said element is received between said side walls to contact said back, said modular sections and said attaching means providing for enlarging and reducing frame means size;

mean for supporting said frame means above the acting space; and means for disconnectably connecting said supporting means and said frame means;

whereby said theatre is readily expandable and portable.

2. A theatre comprising:

a movable curtain for separating acting space from nonacting space;

a light for illuminating said acting space;

overhead frame means for supporting said curtain and said light, said frame means including a plurality of modular sections and first means for disconnectably attaching adjacent said sections together, said attaching means including an element attached to one of each adjacent pair of sections and a cradle for receiving said element attached to a second of said adjacent pair, said modular sections and said attaching means providing for enlarging and reducing frame means size;

means for supporting said frame means above the acting space, said supporting means including means for suspending said frame means from a ceiling of a building, said supporting means including a motor attached to said frame means and connected to said suspending means for powerably raising and lowering said frame means, said supporting means including wiring means connected to a power source and to control means, said control means being located near floor level to facilitate assembling, raising and lowering said frame means; and means for disconnectably connecting said supporting means and said frame means;

whereby said theatre is readily expandable and portable.

3. A theatre in accordance with claim 2 wherein said suspending means includes a cable and a pulley operably arranged for suspending said frame means at a variable location between the ceiling and the floor.

4. A theatre in accordance with claim 2 including a safety line connecting said frame means through slideable holding means attached to said ceiling to an anchor near floor level, said safety line being disconnectable from said anchor while said motor powerably raises and lowers said frame means.

5. A theatre comprising:

a movable curtain for separating acting space from non-acting space;

a light for illuminating said acting space;

overhead frame means for supporting said curtain and said light, said frame means including a plurality of modular sections and first means for disconnectably attaching adjacent said sections together, said attaching means including an element attached to one of each adjacent pair of sections and a cradle for receiving said element attached to a second of said adjacent pair, said modular sections and said attaching means providing for enlarging and reducing frame means size, said frame means including said modular sections and said attaching means connected together into a truss beam;

means for supporting said frame means above the acting space, said supporting means including a pair of motors attached near opposite ends of said truss beam for powerably raising and lowering said truss beam, said supporting means further including cable and pulley assemblies operably connected between a ceiling and said motors and said truss beam; and means for disconnectably connecting said supporting means and said frame means;

whereby said theatre is readily expandable and portable.

6. A theatre comprising:

a movable curtain for separating acting space from nonacting space;

a light for illuminating said acting space;

overhead frame means for supporting said curtain and said light, said frame means including a plurality of modular sections and first means for disconnectably attaching adjacent said sections together, said modular sections and said attaching means providing for enlarging and reducing frame means size, said attaching means including one end of a first adjoining modular section having a first triangular element with a first vertice elevationally beneath second and third vertices and one end of a second adjoining modular section having an open bottom, V-shaped cradle for receiving said triangular element;

means for supporting said frame means above the acting space; and means for disconnectably connecting said supporting means and said frame means;

whereby said theatre is readily expandable and portable.

7. A theatre in accordance with claim 6 wherein a plurality of modular sections are adjoined by said attaching means to form a truss beam, said theatre including second means for disconnectably attaching said truss beam at opposite ends to walls of a building.

8. A portable proscenium theatre comprising:

a movable front cross-over curtain and an upper border masking means together defining a closeable proscenium opening;

a plurality of lights for illuminating acting space behind the proscenium opening;

means for wiring said lights to a controllable power source;

overhead frame means for supporting said curtain, said masking means and said lights, said frame means including:

a plurality of modular first truss sections, said first truss sections having a pair of at least partially spaced apart sides between opposite ends;

first means for disconnectably connecting together ends of adjacent said first truss sections to form first truss beams, said first truss beams spanning transversely the acting space, said first truss beams for supporting said lights and for holding at least a portion of said wiring means between the spaced apart sides, said first connecting means including one end of one of said adjoining first truss sections having a first triangular element with a first vertice elevationally beneath second and third vertices and one end of the other of said adjoining first truss sections including an open bottom, V-shaped cradle for receiving said first triangular element;

a plurality of second truss sections;

second means for disconnectably connecting said second truss sections between substantially parallel aligned first truss beams;

means for supporting said frame means above the acting space; and third means for disconnectably connecting said supporting means and said frame means.

9. A portable proscenium theatre in accordance with claim 8 wherein said first truss sections are triangular in cross-sectional shape with one angle lower than the other two and wherein said wiring means includes a plug strip power distribution box having plugs therein connected to said power source, said plugs being connectable electrically to said lights, said box having an approximately triangular cross-sectional shape to conform to a portion of the shape of said first truss section whereby said box rests stably within said first truss section.

10. A portable proscenium theatre comprising:

a movable front cross-over curtain and an upper border masking means together defining a closeable proscenium opening;

a plurality of lights for illuminating acting space behind the proscenium opening;

means for wiring said lights to a controllable power source;

overhead frame means for supporting said curtain, said masking means and said lights, said frame means including:

a plurality of modular first truss sections, said first truss sections having a pair of at least partially spaced apart sides between opposite ends;

first means for disconnectably connecting together ends of adjacent said first truss sections to form first truss beams, said first truss beams spanning transversely the acting space, said first truss beams for supporting said lights and for holding at least a portion of said wiring means between the spaced apart sides;

a plurality of second truss sections;

second means for disconnectably connecting said second truss sections between substantially parallel aligned first truss beams, said second connecting means including a substantially vertical plate attached to one side of one of said first truss sections, said plate having therein a pair of spaced apart, substantially vertical slots, said second connecting means further including a pair of studs with heads attached to an end of one of said second truss sections, said heads being aligned with and for being received by said slots, whereby the end of said second truss section is connected to and supported by the plate attached to said first truss section;

means for supporting said frame means above the acting space; and third means for disconnectably connecting said supporting means and said frame means.

11. A portable proscenium theatre comprising:

a movable front cross-over curtain and an upper border masking means together defining a closeable proscenium opening;

a plurality of lights for illuminating acting space behind the proscenium opening;

means for wiring said lights to a controllable power source;

overhead frame means for supporting said curtain, said masking means and said lights, said frame means including:

a plurality of modular first truss sections, said first truss sections having a pair of at least partially spaced apart sides between opposite ends;

first means for disconnectably connecting together ends of adjacent said first truss sections to form first truss beams, said first truss beams spanning transversely the acting space, said first truss beams for supporting said lights and for holding at least a portion of said wiring means between the spaced apart sides;

a plurality of second truss sections;

second means for disconnectably connecting said second truss sections between substantially parallel aligned first truss beams;

means for supporting said frame means above the acting space, said supporting means including a plurality of modular, vertical columns, each said column having a pulley rotatably attached to its top, said third connecting means including a plurality of cables attached at one end to said frame means and fastened at a second end to said supporting means, each said cable passing over a pulley, said plurality of cables adjustably holding said frame means on said supporting means; and third means for disconnectably connecting said supporting means and said frame means.

12. A portable proscenium theatre comprising:

a movable front cross-over curtain and an upper border masking means together defining a closeable proscenium opening;

a plurality of lights for illuminating acting space behind the proscenium opening;

means for wiring said lights to a controllable power source;

overhead frame means for supporting said curtain, said masking means and said lights, said frame means including:

a plurality of modular first truss sections, said first truss sections having a pair of at least partially spaced apart sides between opposite ends;

first means for disconnectably connecting together ends of adjacent said first truss sections to form first truss beams, said first truss beams spanning transversely the acting space, said first truss beams for supporting said lights and for holding at least a portion of said wiring means between the spaced apart sides;

a plurality of second truss sections;

second means for disconnectably connecting said second truss sections between substantially parallel aligned first truss beams;

means for supporting said frame means above the acting space;

third means for disconnectably connecting said supporting means and said frame means;

a plurality of side masking curtains; and fourth means for connecting each said side masking curtains to one of said second truss sections, said fourth connecting means including means for movably translating each said curtain, said second truss sections having top channel members, said translating means including a trolley having a body with wheels, said trolley fitting within and being guided by said top channel members.

13. A portable proscenium theatre in accordance with claim 12 wherein said turning means includes a rod pivotably attached atop said trolley, said rod for supporting one of said side masking curtains.

14. A portable theatre comprising:

a front cross-over curtain;

a plurality of lights for illuminating acting space behind said curtain;

overhead frame means for supporting said curtain and said lights, said frame means being comprised of connectable and disconnectable modular sections, said frame means being manually assembled at floor level;

a plurality of vertical columns for supporting said frame means;

means, attached to one of said frame means and said columns, for elevating said frame means from the floor level and retaining at a vertical height, said elevating means including means for lifting said frame means from floor level to an elevated level, said elevating means including motor means for providing power for said lifting means, said elevating means further including means for guiding said frame means with respect to said vertical columns;

whereby said frame means is easily assembled and disassembled manually and elevated thereby making said theatre readily portable.

15. A theatre in accordance with claim 14 wherein said overhead frame means includes a folding traveler track for said cross-over curtain, said frame means further including a frame and means for disconnectably attaching said traveler track to said frame, said traveler track including first, second and third hinges spaced apart from one another, said first and third hinges being on opposite sides of said second hinge and having axes in a plane approximately parallel with said curtain, said first and third hinges being foldable in opposite directions, said second hinge having an axis in a plane approximately perpendicular to said curtain, whereby said traveler track folds compactly at said hinges for easy transport and storage.

16. A theatre in accordance with claim 15 including means for locking said first and third hinges in a folded open position thereby locking portions of said traveler track connected by said hinges in an extended configuration.

17. A theatre in accordance with claim 14 wherein said overhead frame means includes at least one of said modular sections extending laterally across said acting space, said one modular section including two uppermost members, said members being spaced apart and in a plane approximately parallel with the floor, and wherein said overhead frame means further includes a cantilevered member for supporting one of said lights, said cantilevered member including a pair of channels attached thereto for fitting about said uppermost members, one of said channels opening downwardly and the other opening sidewardly to receive said uppermost members, whereby said channels interact to hold said cantilevered member and said light to said uppermost members of said one modular section.

18. A theatre in accordance with claim 14 wherein said motor means includes one motor for each vertical column, said motors being attached to said frame means, said vertical columns having tops, and wherein said lifting means for each said motor and said vertical column includes a cable wrapped at least partially about a pulley attached to the top of a particular said vertical column, one end of said cable being attached to said frame means and a second end being connected to a shaft from a particular said motor.

19. A portable proscenium theatre comprising:

a plurality of vertical cylinders located at least at four corners of a rectangular shape, each said cylinder having a pulley rotatably attached at its top, said pulley having an axis approximately perpendicular with the axis of said cylinder;

base means, attached to each said cylinder, for supporting said cylinders vertically with respect to a floor;

a plurality of modular first truss sections, said first truss sections having a first end with a V-shaped bracket, said bracket having a bottom angle with upwardly extending sides therefrom, said bracket including spaced apart walls along a portion of the bracket sides, said first truss sections having a second end formed from a triangular member, said first truss sections being connected together by second ends fitting within the bracket of first ends to form first truss beams;

a pair of motors attached to said first truss beams near opposite ends thereof, each said motor being attached to a first side of a second bracket, each said motor having a shaft with an axis substantially perpendicular to said cylinders;

a spaced apart pair of two spaced apart rotatable rollers, said rollers being shaped to conform to at least a portion of said cylinders, said rollers being attached to a second side of said second bracket, one of said cylinders being received between two rollers of each said pair;

a plurality of cables, each said cable being connected at one end to said shaft of a particular said motor and passing therefrom over said pulley to be connected at a second end to said first truss beam;

a plurality of second truss members having an upwardly open channel upper member;

means for connecting said second truss members to said first truss beams whereby said first truss beams extend transversely between cylinders while said second truss members longitudinally connect parallel first truss beams;

a plurality of cantilevered members removeably attached to said first truss beams for supporting lights therefrom;

means for wiring said lights and said motors to power means and to control means;

a foldable traveler track connected to a first truss beam for supporting a cross-over curtain therefrom;

means for masking said first truss beams; and a plurality of side masking curtains suspended from rods pivotally attached atop trolleys fitting within and being guided by the top channel members of said second truss members.

20. Support apparatus comprising:

a column;

base means, attached to said column, for supporting said column vertically on a floor;

a first truss member for extending approximately perpendicularly from said column to support a load, said first truss member having first and second opposite ends, said first truss member including a bracket member spaced apart from the first end toward the second end, said first truss member including mean for receiving a second truss member at one of said first and second ends of said first truss member;

means for guiding said first truss member along said column, said guiding means being attached to said bracket member on a first side toward the first end of said first truss member; and means for powerably moving said first truss member along said column, said moving means including a motor and means for controlling said motor remotely from said first truss member, said motor being attached to said bracket member on a second side toward the second end of said first truss member;

whereby the location of said bracket member allows for said guiding means and said motor to be between the first and second ends of said first truss member so that receiving means may be at one of the first and second ends to receive a second truss member.

21. Support apparatus comprising:

a column;

base means, attached to said column, for supporting said column vertically on a floor;

a first truss member for extending approximately perpendicularly from said column to support a load, said first truss member having a V-shaped bracket at a first end, said bracket having an apex angle with sides extending upwardly therefrom, said bracket including spaced apart walls extending inwardly from its sides;

a second truss member having a first triangular end for being removably received by said bracket, whereby both said first and second truss members may be used to support a load;

means, attached to said truss member, for guiding said first truss member along said coulmn;

means, attached to said first truss member, for powerably moving said first truss member along said column, said moving means including a motor and means for controlling said motor remotely from said first truss member.

22. A support apparatus comprising:

a modular, cylindrical column;

base means, attached to said column, for supporting said column vertically with respect to a floor;

a first truss member for extending approximately perpendicularly from said column to support a load, said first truss member having a triangular cross-section and a V-shaped bracket at a first end, said bracket having a bottom angle with upwardly extending sides therefrom, said bracket including spaced apart walls along a portion of the bracket sides and extending inwardly from the sides, said first truss member further including a second bracket spaced apart from said first bracket, said first truss member including a spaced apart pair of two spaced apart rotatable rollers, said rollers being shaped to conform to at least a portion of said column, said rollers being attached to said second bracket in a space between said first and second brackets, said column being received between two rollers of each said pair;

a motor attached to said second bracket on a side opposite said rollers, said motor including a shaft extending through said second bracket;

a pulley rotatably attached to the top of said column; and a cable connected at one end to said shaft and passing therefrom over said pulley to be connected at a second end to said first truss member; and a second triangular truss member having a first end being removeably received by said first bracket of said first truss member;

whereby said column supports a pair of truss members to which a load may be attached such that said motor in combination with said pulley and said cable powerably moves said truss members and load upwardly or downwardly along said column as guided by said rollers.

23. The method of constructing a proscenium theatre comprising the steps of:

emplacing a plurality of vertical cylinders at least at four corners of a rectangular shape;

connecting a first modular frame section to each said cylinder located at said corners, each said first modular frame sections including guide means and a motor to powerably move said first modular frame sections along said cylinders;

connecting additional modular frame sections to said first modular frame sections to form a frame with longitudinally and transversely connected frame sections;

connecting a plurality of cantilevered members to transversely extending portions of said frame;

attaching a plurality of lights to one of said frame and said cantilevered members;

wiring said lights and said motors to power means and to control means, said wiring being supported at least partially by said transversely extending portions of said frame;

attaching a traveler track with attached cross-over curtain to a transversely extending portion of said frame thereby defining a front for said theatre;

attaching masking curtains to said frame to mask frame portions and lights from audience view and to define a proscenium opening; and operating said motors simultaneously to raise said frame along said cylinders to an overhead location.

24. Interconnect mechanism for first and second truss members, said truss members including three triangularly spaced structural elements, said mechanism comprising:

a first triangular plate attached between the three structural elements of said first truss member; and means, attached to said second member, for receiving said first plate, said receiving means including a second triangular plate, said second plate having a lower apex with diverging edges rising therefrom, said receiving means also including side walls spaced from said second plate near said diverging edges and back walls connecting said side walls and said second plate at the diverging edges;

whereby said first triangular plate fits against said back walls between said side walls and said second plate thereby being held by gravity in said receiving means.

25. Mechanism in accordance with claim 24 wherein said side walls and said back walls are spaced from corners of said second triangular plate thereby providing space for said three structural elements of said first member.

26. Mechanism in accordance with claim 34 wherein said first and second triangular plates include central openings for passing items therethrough.

* * * * *

UNITED STATES PATENT AND TRADEMARK OFFICE

CERTIFICATE OF CORRECTION

PATENT NO. : 4,512,117

DATED : April 23, 1985

INVENTOR(S) : Fredric A. Lange

It is certified that error appears in the above-identified patent and that said Letters Patent is hereby corrected as shown below:

Column 17, claim 20, line 32, delete "mean" and insert --means--

Column 17, claim 21, line 68, delete "coulmn" and insert therefor --column--.

Column 20, claim 26, line 13, delete "34" and insert --24--.

Signed and Sealed this

*Eleventh* Day of *February 1986*

[SEAL]

*Attest:*

DONALD J. QUIGG

*Attesting Officer*

*Commissioner of Patents and Trademarks*